US009107497B1

(12) United States Patent
Al-Habsi

(10) Patent No.: US 9,107,497 B1
(45) Date of Patent: Aug. 18, 2015

(54) AUTOMATIC BOOK-END SYSTEM FOR SHELVES

(71) Applicant: SULTAN QABOOS UNIVERSITY, Muscat (OM)

(72) Inventor: Yaqoob Saif Al-Habsi, Al-Khodh (OM)

(73) Assignee: SULTAN QABOOS UNIVERSITY, Muscat (OM)

( * ) Notice: Subject to any disclaimer, the term of this patent is extended or adjusted under 35 U.S.C. 154(b) by 0 days.

(21) Appl. No.: 14/529,039

(22) Filed: Oct. 30, 2014

(51) Int. Cl.
*A47B 63/06* (2006.01)
*A47B 65/00* (2006.01)
*A47F 3/08* (2006.01)

(52) U.S. Cl.
CPC ..... *A47B 63/06* (2013.01); *A47B 65/10* (2014.12); *A47F 3/08* (2013.01)

(58) Field of Classification Search
CPC ..... A47B 65/00; A47B 65/10; A47B 65/15; A47B 65/20; A47B 63/00; A47B 63/06; A47B 57/58; A47B 57/583; A47B 57/585; A47B 57/586; A47F 3/08
USPC ..... 211/42, 43, 184, 1.51, 1.57, 51
See application file for complete search history.

(56) References Cited

U.S. PATENT DOCUMENTS

| | | | | | |
|---|---|---|---|---|---|
| 497,993 | A | * | 5/1893 | Thomson | 211/51 |
| 1,283,259 | A | * | 10/1918 | Monsarrat | 211/43 |
| 1,290,512 | A | * | 1/1919 | Coleman | 211/51 |
| 1,401,171 | A | * | 12/1921 | Manny | 248/448 |
| 1,460,642 | A | * | 7/1923 | Cadenhead | 211/43 |
| 1,675,269 | A | * | 6/1928 | Hine | 108/61 |
| 1,704,011 | A | * | 3/1929 | Hobart | 211/43 |
| 1,780,872 | A | * | 11/1930 | Dumben | 108/28 |
| 1,806,642 | A | * | 5/1931 | Ohnstrand | 108/61 |
| 1,876,346 | A | | 9/1932 | Riddel | |
| 1,910,516 | A | * | 5/1933 | Besenberg et al. | 220/536 |
| 2,060,146 | A | * | 11/1936 | Voorhees | 312/273 |
| 2,134,606 | A | * | 10/1938 | Hackworth et al. | 108/27 |
| 2,140,656 | A | * | 12/1938 | Smith | 211/43 |
| 2,264,017 | A | * | 11/1941 | Bowmen | 108/28 |

(Continued)

FOREIGN PATENT DOCUMENTS

| | | |
|---|---|---|
| CN | 201641031 U | 11/2010 |
| CN | 201806235 U | 4/2011 |

(Continued)

OTHER PUBLICATIONS

Izzy Swan's Drill Powered Book-end http://www.youtube.com/watch?v=-WT8Ldbb0kU Retrieved from Internet on Jun. 18, 2014.

*Primary Examiner* — Stanton L Krycinski
(74) *Attorney, Agent, or Firm* — Richard C Litman

(57) ABSTRACT

The automatic book-end system for shelves includes a shelf, a book-end housing that is movably connected to the shelf, and a limit switch connected to the book-end housing. The housing includes a rechargeable battery, an electric circuit, electric motors, and a pair of chain sprockets. The shelf includes a pair of roller chains that engage the chain sprockets. The electric motors, chain sprockets, and roller chains work in conjunction to achieve linear motion of the housing along the shelf bottom. The book-end housing can support the books in an upright, side by side arrangement on the shelf. Once a book is removed from the shelf, the housing is automatically repositioned to push the remaining books together and close any resulting gaps between the remaining books.

6 Claims, 4 Drawing Sheets

(56) References Cited

U.S. PATENT DOCUMENTS

| | | | | | |
|---|---|---|---|---|---|
| 2,284,849 | A | * | 6/1942 | Schreyer | 211/43 |
| 2,534,456 | A | | 12/1950 | Kudrikoff | |
| 2,545,844 | A | | 3/1951 | Cougias | |
| 2,733,719 | A | * | 2/1956 | Lear | 211/51 |
| 2,884,139 | A | * | 4/1959 | Dunham | 211/184 |
| 2,911,103 | A | * | 11/1959 | Kunkler | 211/43 |
| 3,142,384 | A | * | 7/1964 | Fridolph | 211/43 |
| 3,301,407 | A | * | 1/1967 | Jones | 211/184 |
| 3,389,805 | A | * | 6/1968 | Yeomans | 211/43 |
| 3,446,160 | A | * | 5/1969 | Dahl, Jr. | 104/235 |
| 3,487,945 | A | | 1/1970 | Barham | |
| 3,655,292 | A | * | 4/1972 | Savage | 402/63 |
| 4,351,439 | A | * | 9/1982 | Taylor | 211/59.3 |
| 4,457,512 | A | * | 7/1984 | Stevenson | 273/148 A |
| 4,682,696 | A | * | 7/1987 | Sheu | 211/43 |
| 4,729,481 | A | * | 3/1988 | Hawkinson et al. | 211/59.3 |
| 5,161,700 | A | * | 11/1992 | Stannis et al. | 211/175 |
| 5,217,122 | A | * | 6/1993 | Martinez | 211/43 |
| 5,381,908 | A | * | 1/1995 | Hepp | 211/184 |
| 5,765,697 | A | * | 6/1998 | Soong | 211/11 |
| 5,833,076 | A | * | 11/1998 | Harres et al. | 211/51 |
| 5,871,104 | A | | 2/1999 | Martinez et al. | |
| 6,515,590 | B1 | * | 2/2003 | Lauria | 340/692 |
| 6,535,790 | B2 | | 3/2003 | Nakano et al. | |
| 6,974,041 | B2 | | 12/2005 | Salemi | |
| 8,646,650 | B2 | * | 2/2014 | Lockwood et al. | 221/151 |
| 2006/0237381 | A1 | * | 10/2006 | Lockwood et al. | 211/59.3 |
| 2013/0341292 | A1 | * | 12/2013 | Johnson et al. | 211/1.57 |

FOREIGN PATENT DOCUMENTS

| | | | | | |
|---|---|---|---|---|---|
| CN | 201958201 | U | | 9/2011 | |
| CN | 203016268 | U | | 6/2013 | |
| DE | 3310293 | A1 | * | 9/1984 | A47B 65/00 |

* cited by examiner

AUTOMATIC BOOK-END SYSTEM FOR SHELVES

BACKGROUND OF THE INVENTION

1. Field of the Invention

The present invention relates to book-ends for shelves, and particularly to an automatic book-end for shelves.

2. Description of the Related Art

Library books are handled by many people including staff, children, and patrons. As such, maintaining books in a predetermined order and upright arrangement on library shelves is a cumbersome task. This task is made even more difficult when users misplace books on library shelves. If the misplaced book is not in the immediate vicinity of its assigned location, searching for the misplaced book can be particularly daunting.

Thus, an automatic book-end system for shelves solving the aforementioned problems is desired.

SUMMARY OF THE INVENTION

The automatic book-end system for shelves includes a shelf, a book-end housing that is movably connected to the shelf, and a limit switch connected to the book-end housing. The housing includes a rechargeable battery, an electric circuit, electric motors, and a pair of chain sprockets. The shelf includes a pair of roller chains that engage the chain sprockets. The electric motors, chain sprockets, and roller chain work in conjunction to achieve linear motion of the housing along the shelf bottom. The automatic book-end system for shelves can be disposed on a book shelf or other horizontal support surface and the book-end housing can support the books in an upright, side by side arrangement on the shelf. Once a book is removed from the shelf, the limit switch energizes the electric circuit thereby causing the motors to move the housing forward to close any resulting gaps between the remaining books. When the limit switch touches the first book it deenergizes the electric circuit causing the motors to stop movement of the housing. In other words, books remaining on a shelf after a space or gap has been created by removal of a book from the shelf can be pushed together and supported by the book-end housing such that no space is left for the removed book to be reshelved.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
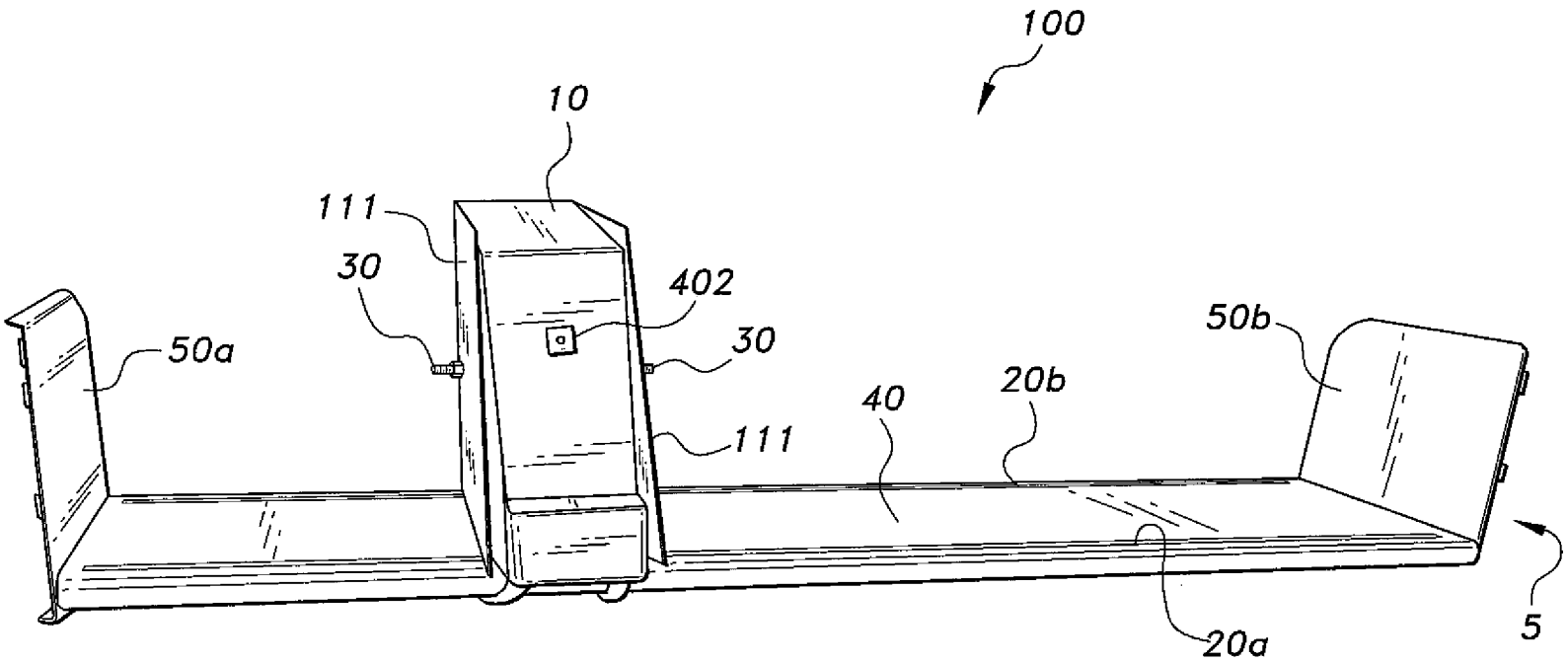
FIG. 1 is a perspective view of the automatic book-end system for shelves according to the present invention.
Figure 2:
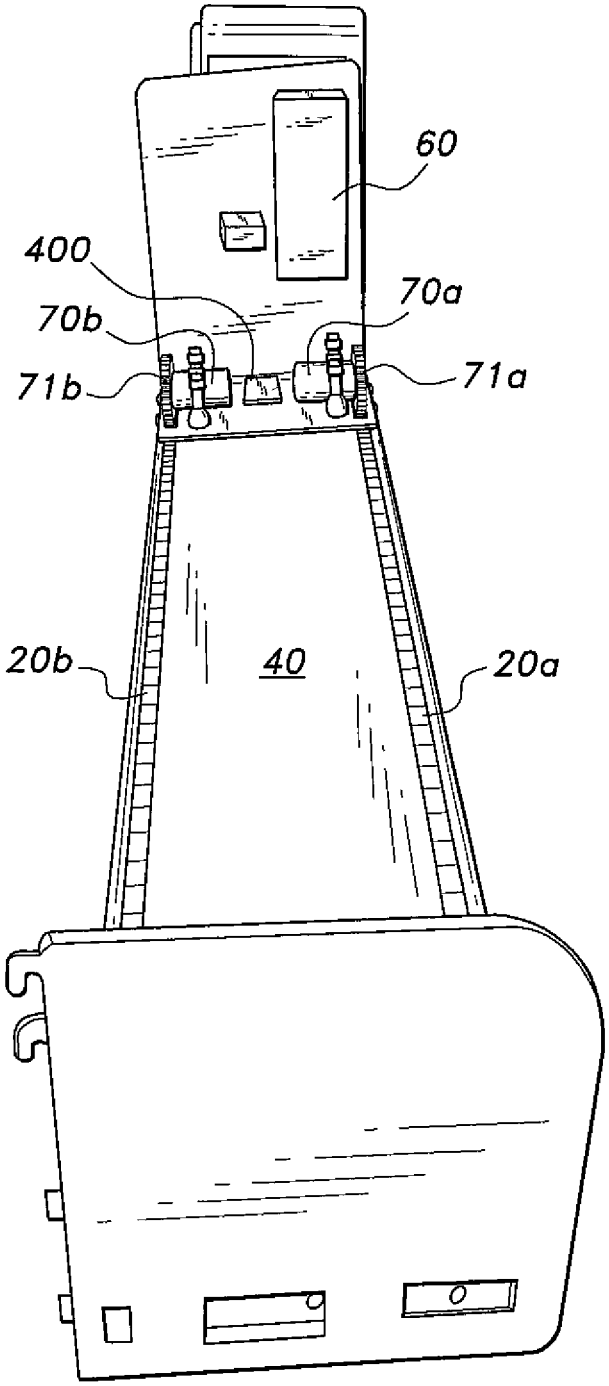
FIG. 2 is a top perspective view of the automatic book-end system for shelves according to the present invention.
Figure 3:
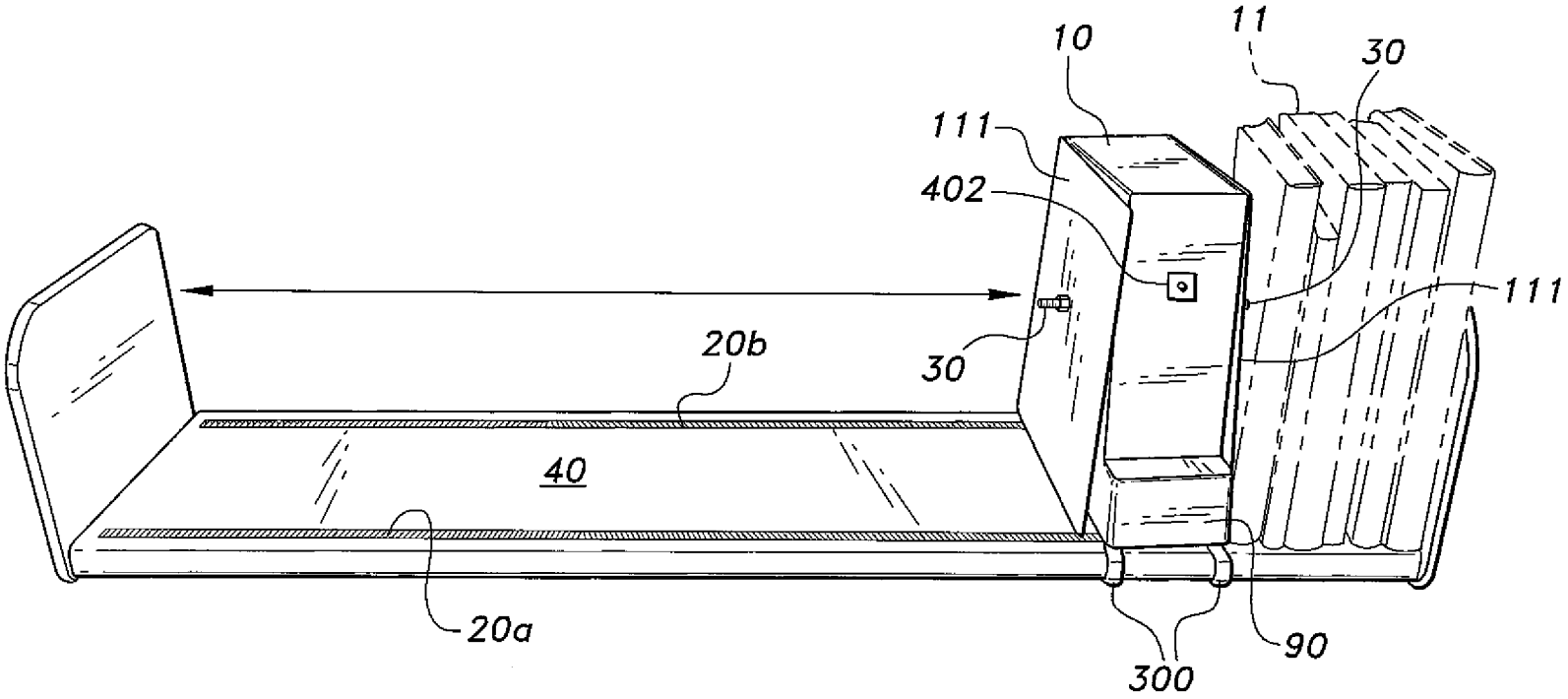
FIG. 3 is a front perspective view of the automatic book-end system for shelves, showing the battery charger according to the present invention.
Figure 4:
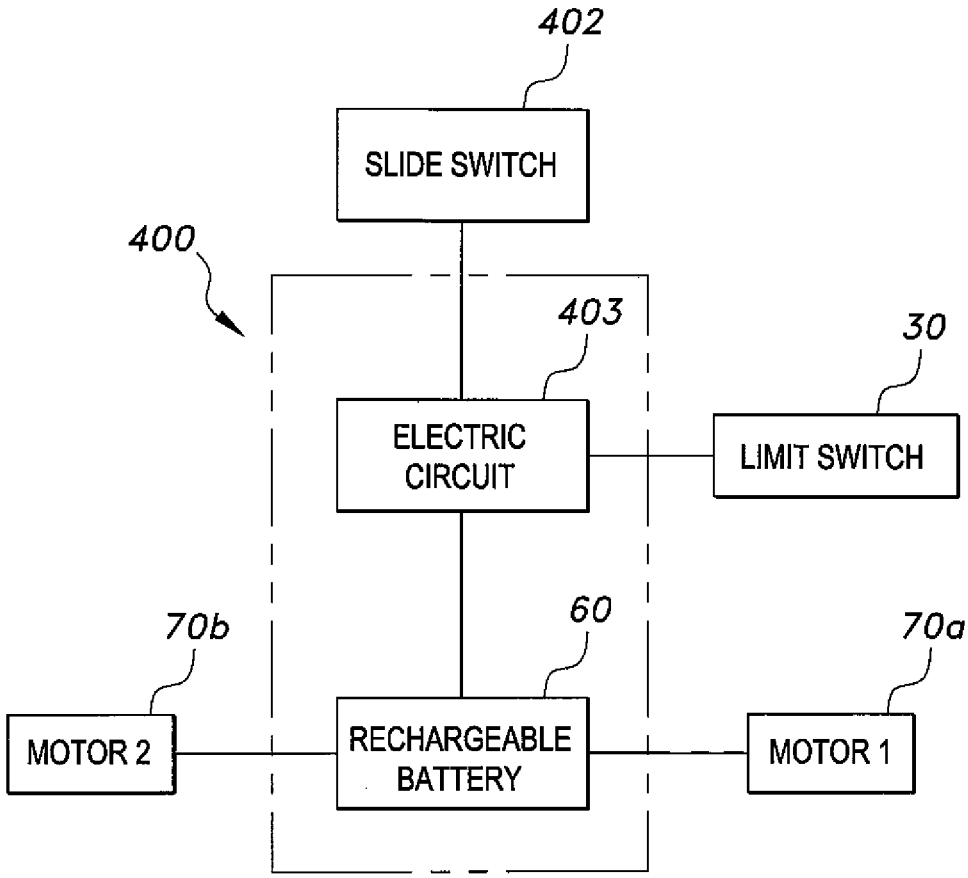
FIG. 4 is a block diagram showing components of the book-end system for shelves according to the present invention.

As shown in FIGS. 1 through 4, the automatic book-end system for shelves 100 includes a shelf 5, a book-end housing 10 that is movably connected to the shelf 5, and a limit switch 30 connected to the book-end housing 10. The housing 10 includes a rechargeable battery 60, an electric circuit board 400, electric motors 70*a* and 70*b* (e.g., Direct Current (DC) gear motors or DC sprocket motors), a slide switch 402, and a pair of chain sprockets 71*a* and 71*b*. Electric circuit 403, and rechargeable battery 60 are disposed on the electric circuit board 400. The shelf 5 includes a pair of roller chains 20*a* and 20*b* that engage the chain sprockets 71*a* and 71*b*. The electric motors 70*a* and 70*b* and chain sprockets 71*a* and 71*b* work in conjunction to achieve linear motion of the housing 10 along the shelf bottom 40. The automatic book-end system for shelves 100 can be disposed on a book shelf or other horizontal support surface and the book-end housing 10 can support the books in an upright, side by side arrangement on the shelf 5. Once a book is removed from the shelf 5, a signal can be transmitted from the limit switch 30 to the electric circuit 403 to coordinate repositioning of the housing 10 and thereby close any resulting gaps between the books 11. In other words, books 11 remaining on a shelf after a space or gap has been created by removal of a book from the shelf can be pushed together and supported by the book-end housing 10 such that no space is left for the removed book to be reshelved.

The electric circuit 403 is connected to the slide switch 402, rechargeable battery 60 and the limit switch 30. When the slide switch 402 is placed 'ON', a contact state of limit switch 30 (e.g., contact between limit switch 30 and a book on shelf) controls the energizing and deenergizing of electric circuit 403. When the slide switch 402 is "ON" and a book is removed from the shelf 40, the limit switch 30 energizes the electric circuit 403, which in turn actuates the motors 70*a* and 70*b* to rotate the sprockets 71*a* and 71*b* which engage the chains 20*a* and 20*b*. Rotation of the sprockets 71*a* and 71*b* cause forward movement of the bookend housing 10, thereby allowing smooth linear travel of the bookend housing 10 along the bookshelf bottom surface 40 until the limit switch 30 again contacts books 11 and, thereby, deactuates the motors 70*a* and 70*b*. The rechargeable battery 60 powers the electric circuit 403, and electric motors 70*a*, 70*b*.

The shelf 5 can include at least one end wall, e.g., opposing first and second end walls 50*a* and 50*b*, which extend normal to the horizontally extending shelf bottom 40. First and second roller chains 20*a* and 20*b* are disposed on the bottom 40 of shelf 5, e.g., parallel to and proximate front and back side edges of the shelf bottom 40. First and second chain sprockets 71*a* and 71*b* are attached to rotor portion of motors 70*a*, 70*b*. The sprockets 71*a* and 71*b* extend from the housing 10. First and second roller chains 20*a* and 20*b* and first and second roller chain sprockets 71*a* and 71*b* operate in conjunction with motors 70*a* and 70*b* to achieve linear motion of the housing 10 along the shelf bottom 40. First and second roller chains 20*a* and 20*b* have cavities that engage teeth of chain sprockets 71*a* and 71*b*, respectively. In detail, chain sprockets 71*a* and 71*b* are connected to the motors 70*a* and 70*b*, respectively. Motors 70*a* and 70*b* can be energized to rotate chain sprockets 71*a* and 71*b* so that the chain sprockets 71*a* and 71*b* mesh with the roller chains 20*a* and 20*b*, respectively, and cause linear motion of the housing 10 along the shelf bottom 40. The housing 10 can further include U-shaped travel guide clips 300, which are slidably fastened to the shelf bottom 40 to stabilize the vertical stance and linear movement of the housing 10.

Exemplary characteristics of each motor, 70*a*, 70*b* can include 6 volt DC operation rated for approximately 10 RPM speed. The battery 60 can include, for example, a 12 volt battery rated at approximately 6500 mAh. As known by persons having ordinary skill in the art, a voltage divider/regulation system may be employed in the circuit so as not to exceed the 6 volt DC rating of the electric motors 70*a* and 70*b* depending on the weight of the books on the shelf. A plug-in battery charger 90 can be disposed on the housing to provide charging current to recharge the 12 volt battery 60 when the charger is connected to an Alternating Current (AC) mains outlet. The roller chains 20*a* and 20*b* can be any suitable roller chains. The roller chains 20*a* and 20*b* can, for example, conform to International Standards Organization ("ISO") designation 05b. The chain sprockets 71*a* and 71*b* can be any suitable chain sprockets. The chain sprockets 71*a* and 71*b* can, for example, conform to ISO designation 04-1b20.

The limit switch 30 is operably connected with the electric circuit 403 and is disposed on a book-contact cover 111 of the housing 10. The book-contact cover 111 of the housing includes a surface of the housing that can directly contact the face of a book positioned upright on the shelf 5. The limit switch 30 can be configured, as is known in the art, to interrupt energized travel of the housing 10 upon a predetermined sufficient force of contact with a book on the shelf. Further, the limit switch 30 can be configured to initiate operation of the motors and subsequent movement of the housing 10 once one or more books are removed from shelf 5. For example, the limit switch 30 can be configured to include sensors that detect a change in pressure exerted on the housing 10 and to transmit an appropriate signal to the electric circuit 403. In this manner, the housing 10 can automatically push books together and close any space or gap created by removal of the book(s). An exemplary housing 10 so configured can push books up to a resistance force of approximately 38 kg.

Preferably, the housing 10 is 25 cm×8 cm×23 cm in size. The dimensions of the housing can vary depending on the available shelf size. The shelf 5 and housing 10 can be made from any suitable material. Preferably, the shelf 5 and/or housing 10 are made from a metal such as iron, or a non-metal, such as wood.

It is to be understood that the present invention is not limited to the embodiments described above, but encompasses any and all embodiments within the scope of the following claims.

I claim:

1. An automatic book-end system for shelves, comprising:

a shelf including a shelf bottom, at least one end wall extending normal to the shelf bottom and first and second roller chains disposed on the shelf bottom, parallel to and proximate opposing side edges of the shelf bottom;

a book-end housing movably connected to the shelf, the book-end housing including a book contacting surface, a battery, an electric circuit powered by the battery, a pair of electric motors operably connected to the electric circuit, and first and second chain sprockets operably connected to the electric motors, each of the first and second roller chains being configured to engage a respective one of said first and said second chain sprockets;

a limit switch disposed on the book contacting surface of the book-end housing, the limit switch being operably connected to the electric circuit; and wherein responsive to a contact state of the limit switch, the electric circuit actuates or deactuates the motors to coordinate automatic repositioning of the book-end housing along the shelf bottom.

2. The automatic book-end system for shelves according to claim 1, wherein the electric motors include Direct Current gear motors.

3. The automatic book-end system for shelves according to claim 1, wherein the electric motors include Direct Current sprocket motors.

4. The automatic book-end system for shelves according to claim 1, wherein the electric circuit is operably connected to a slide switch.

5. The automatic book-end system for shelves according to claim 1, further comprising a plug-in battery charger connected to the book-end housing, the plug-in battery charger configured to provide charging current to recharge the battery when the charger is connected to an Alternating Current mains outlet.

6. The automatic book-end system for shelves according to claim 1, further comprising U-shaped travel guide clips attached to the book-end housing and slidably fastened to the shelf bottom.

* * * * *